US005292261A

United States Patent [19]

Hirano et al.

[11] Patent Number: 5,292,261

[45] Date of Patent: Mar. 8, 1994

[54] TERMINAL RETAINER FOR CONNECTOR

[75] Inventors: Seiji Hirano, Aki; Kenji Takenouchi; Toshihiko Makita, both of Haibara, all of Japan

[73] Assignee: Yazaki Corporation, Tokyo, Japan

[21] Appl. No.: 608,586

[22] Filed: Oct. 31, 1990

Related U.S. Application Data

[63] Continuation of Ser. No. 398,562, Aug. 25, 1989, abandoned.

[30] Foreign Application Priority Data

Aug. 30, 1988 [JP] Japan ..... 63-112834[U]

[51] Int. Cl.[5] ..... H01R 13/436

[52] U.S. Cl. ..... 439/752; 439/595

[58] Field of Search ..... 439/594, 595, 598, 733, 439/752

[56] References Cited

U.S. PATENT DOCUMENTS

| | | | |
|---|---|---|---|
| 4,045,110 | 8/1977 | Sterken | 439/595 |
| 4,433,888 | 2/1984 | Winger | 439/752 |
| 4,548,461 | 10/1985 | John et al. | 439/733 |
| 4,583,805 | 4/1986 | Mantlik | 339/61 |
| 4,749,373 | 6/1988 | Brekosky et al. | 439/595 |
| 4,824,404 | 4/1989 | Bullard | 439/752 |
| 4,900,291 | 2/1990 | Colleran et al. | 439/595 |
| 4,902,247 | 2/1990 | Suzuki et al. | 439/595 |
| 4,921,437 | 5/1990 | Cooper et al. | 439/595 |
| 4,973,268 | 11/1990 | Smith et al. | 439/595 |

*Primary Examiner*—Gary F. Paumen

*Attorney, Agent, or Firm*—Armstrong, Westerman, Hattori, McLeland & Naughton

[57] ABSTRACT

In a connector system comprising a connector housing having a terminal chamber, a terminal member to be inserted into the terminal chamber, and a terminal retainer to be coupled to a rear portion of the connector housing in two stages, namely, in a first-step engagement and a second-step engagement, the terminal retainer comprising flexible pins extending toward the front side in the terminal chamber, the flexible retainer comprising an engaging end portion capable of being restored to an advance path of the terminal member, and the terminal chamber provided with a stopper for detecting unsatisfactory insertion of the terminal member, the stopper located on the front side of the flexible engaging end of the terminal retainer in the first-step engagement, the engaging end portion, when not restored due to unsatisfactory insertion of the terminal member, making abutting engagement with the stopper when the terminal retainer is tried to be moved to the second-step engagement.

2 Claims, 5 Drawing Sheets

TERMINAL RETAINER FOR CONNECTOR

This application is a continuation of application Ser. No. 398,562 filed Aug. 25, 1989, now abandoned.

BACKGROUND OF THE INVENTION (1) Field of the Invention

This invention relates to the structure of a terminal retainer to be coupled to a connector housing in order to prevent the after insertion slip-off of a terminal member inserted in a terminal chamber in the connector housing of a connector used for connection of a wire harness or the like.

(2) Description of the Prior Art

For retaining a terminal member inserted in a terminal chamber of a connector housing, it has been a general practice to provide a flexible locking arm integrally on an inner wall of the terminal chamber and to engage the locking arm with the terminal member inserted into the terminal chamber, thereby preventing the after insertion slip-off of the terminal member. Recently, it has been proposed that a terminal retainer be coupled to a rearward portion of the connector housing to prevent securely the after insertion slip-off of the terminal member, by both the terminal retainer and the above-mentioned flexible locking arm or by the terminal retainer in place of the flexible locking arm.

FIG. 9 illustrates the prior art as to the locking structure mentioned above. In this figure, support projections d, d are provided on the inner surfaces of opposite walls c, c of a terminal chamber b in a connector housing a. Tapered actuating surfaces e, e are provided at rearward portions of the support projections d, d. On the outer surfaces of the walls c, c are provided tentative arresting projections f, f and arresting projections g, g in that order from the rearward to the forward side.

Also shown in the figure is a frame-shaped terminal-retaining member h. The terminal-retaining member h comprises, at the inner and outer sides of a frame body i, flexible locking arms j, j and flexible pins k, k both extending toward the forward portion of the connector housing a to be combined therewith.

In coupling the terminal-retaining member h to the connector housing a, a first-step engagement is first established in which the flexible lock arms j, j are engaged with the first arresting projections f, f. In this condition, the flexible pins k, k are extended straight forwardly so that they do not interfere with a terminal member l inserted into the terminal chamber b.

Next, the terminal-retaining member h is pushed forward to establish a second-step engagement in which the flexible lock arms j, j are engaged with the second arresting projections g, g, as shown in FIG. 10. In this condition, tips $k_1$, $k_1$ of the flexible pins k, k contacts the tapered actuating surfaces e, e and forcibly bent inward to hold an electric wire clamp portion m therebetween to be disposed on the rear side of support projections n, o of the terminal member l to prevent the after insertion slip-off of the terminal member l.

In the prior art, when the terminal-retaining member h is pushed forward from the first-step engagement to the second-step engagement with respect to the connector housing a, the tips $k_1$, $k_1$ of the flexible pins k, k are forcibly bent inward by the tapered actuating surfaces e, e to clamp the terminal member l therebetween. In this case, therefore, there is the possibility that the terminal member l in an unsatisfactorily inserted condition may be clamped as it is. Thus, the terminal-retaining member h does not have a function of checking the unsatisfactory insertion of the terminal member l.

SUMMARY OF THE INVENTION

It is accordingly an object of this invention to provide a terminal retaining member with the function of checking an unsatisfactorily inserted condition of a terminal member.

The above object is attainable according to this invention, in a connector comprising a connector housing having terminal chambers, a terminal member to be inserted into each terminal chamber, and a terminal retainer to be coupled to a rearward portion of the connector housing in two stages, namely, in a first-step engagement and a second-step engagement, The terminal retainer comprises flexible pins extending forwardly into the terminal chamber. Each flexible pin comprises an engaging end portion capable of being restored to an advance path of the terminal member. The terminal chamber is provided with a stopper for detecting unsatisfactory insertion of the terminal member. A stopper is located on the front side of flexible pin of the terminal retainer in the first-step engagement. The engaging end portion, when not restored due to unsatisfactory insertion of the terminal member, is in abutting engagement with the stopper when the terminal retainer is moved to the second-step engagement.

With this structure, it is possible to detect the unsatisfactory insertion of the terminal retainer, to secure the second-step engagement of the terminal retainer with the terminal metal piece, and thereby to prevent the after insertion slip-off of the terminal member.

The above and other objects, features and advantages of the invention will become apparent from the following description and the appended claim, taken in conjunction with the accompanying drawings which show by way of example some preferred embodiments of the invention.

DESCRIPTION OF THE PREFERRED EMBODIMENTS

Figure 1:
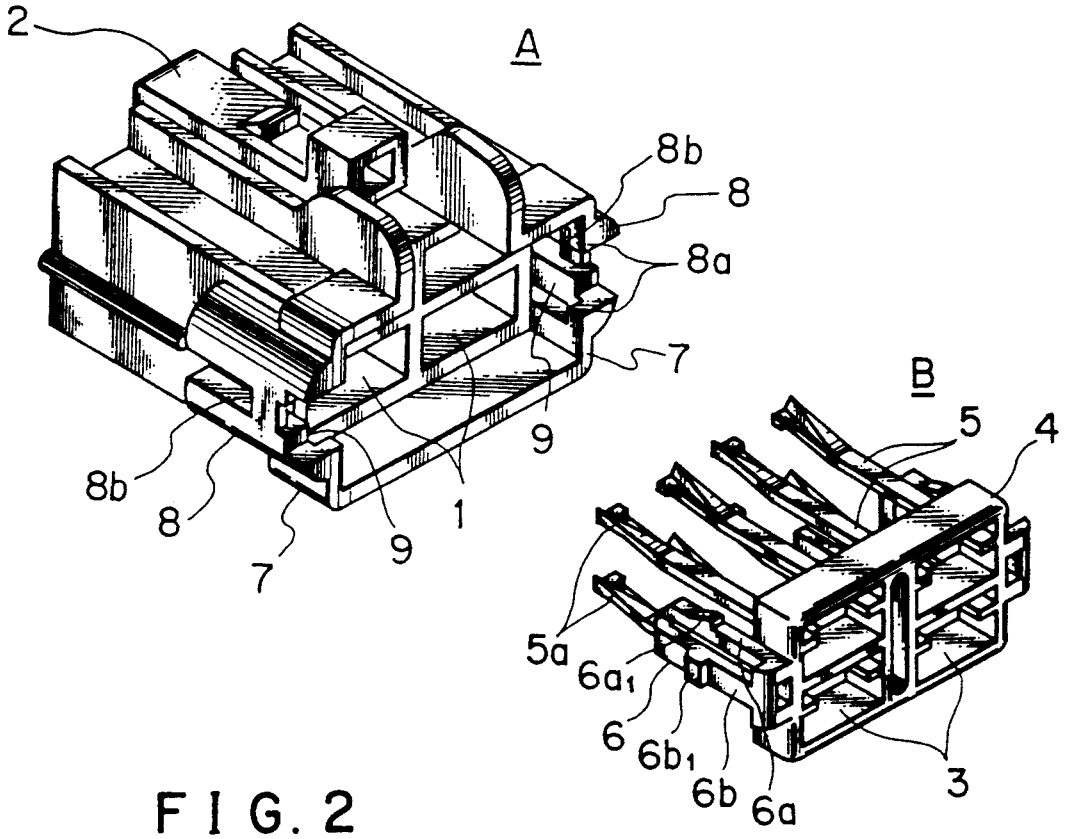
FIG. 1 is an exploded perspective view of a connector housing and a terminal retainer therefor according to one embodiment of this invention.
Figure 2:
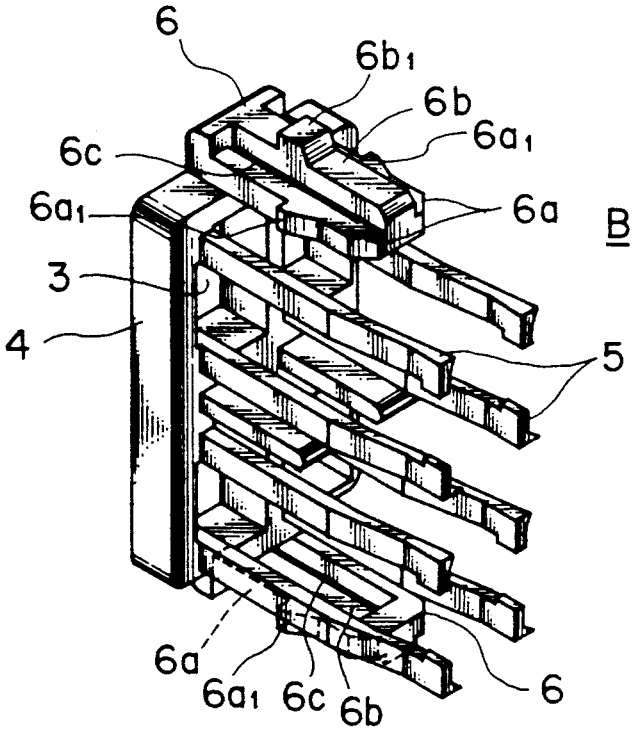
FIG. 2 is a perspective view of the terminal retainer.

In FIG. 1, there are shown a male connector housing A made of a synthetic resin and a terminal retainer B made of a synthetic resin to be coupled to a rearward portion of the male connector housing A. The male connector housing A is fitted into a mating, female connector housing (not shown).

The connector housing A is provided therein with a plurality of terminal chambers 1, in upper and lower rows. The connector housing A is provided at an outer portion thereof with a flexible lock arm 2 for mating with the female connector housing.

The terminal retainer B comprises a frame-shaped main body portion 4 provided therein with insertion portions 3 each of which permits insertion therethrough of a terminal member and an electric wire connected thereto. A plurality of flexible pins 5 forwardly extend from the main body portion 4 in their respective terminal chambers 1 arranged in the upper and lower rows. The flexible pins 5 extend substantially straight from the main body portion 4. However, an end portion thereof 5*a* is bent so as to be gradually inclined. From both side portions of the main body portion 4, lock arms 6, 6 for the connector housing A are provided to extend forwardly.

The lock arms 6 each comprises a pair of vertically flexible pieces 6*a*, 6*a* arranged on the upper and lower sides, with a gap 6*c* therebetween, and a horizontally flexible piece 6*b* which is provided at the side of the vertically flexible pieces 6*a*, 6*a* opposite the gap 6*c* and capable of being let in and out of the gap 6*c*. The vertically flexible piece 6*a* is provided with a first projection $6a_1$. The horizontally flexible piece 6*b* is provided with a second projection $6b_1$ on the rearward side of the first projection $6a_1$.

Bulged walls 8, 8 are provided at rearward portions of side walls 7, 7 of the connector housing A, and are provided with portions 9, 9 for receiving the lock arms 6, 6. Locking portions 8*a* for the first projection $6a_1$ are provided at upper and lower positions of the rearward end of the bulged wall 8 so as to form the receiving portion 9. A locking portion 8*b* for the second projection $6b_1$ is provided on a side surface of the bulged wall 8, on the forward side of the locking portions 8*a*.

Figure 3:
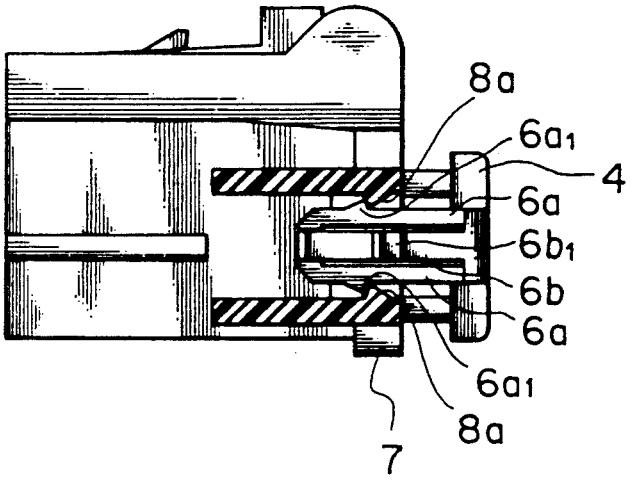
FIG. 3 is a side view, partly in section, of the connector housing and the terminal retainer in a first-step engagement.

In the above-mentioned construction, the connector housing A and the terminal retainer B, before the insertion of the terminal member, are in a first-step engagement in which the first projections $6a_1$ of the vertically flexible pieces 6*a* are in engagement with the locking portions 8*a* in the receiving portions 9, as shown in FIG. 3. In this condition, the terminal members connected to the electric wires are inserted through the insertion portions 3 of the terminal retainer B into the terminal chambers 1 to be engaged with flexible fastening arms 11.

Figure 4:
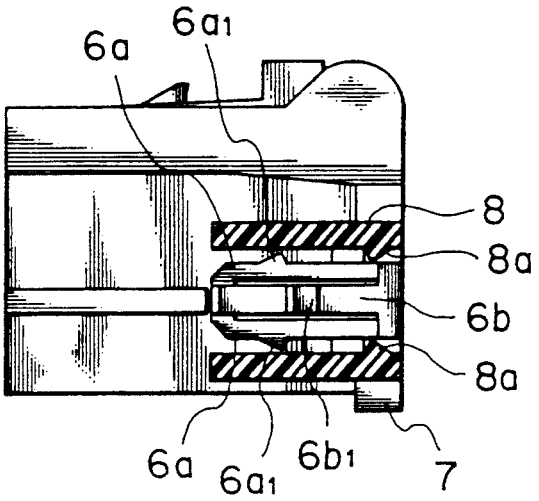
FIG. 4 is a side view, partly in section, of the connector housing and the terminal retainer in a second-step engagement.

Next, the terminal retainer B is pushed into the connector housing A to bring the second projections $6b_1$ of the lock arms 6 into engagement with the locking portions 8*b* in the receiving portions 9, establishing a second-step engagement, as shown in FIG. 4. In this condition, the flexible pins 5 are located in proximity to the respective positions for engagement with the terminal members, thereby achieving double lock against the after insertion slip-off of the terminal members.

Figure 5:
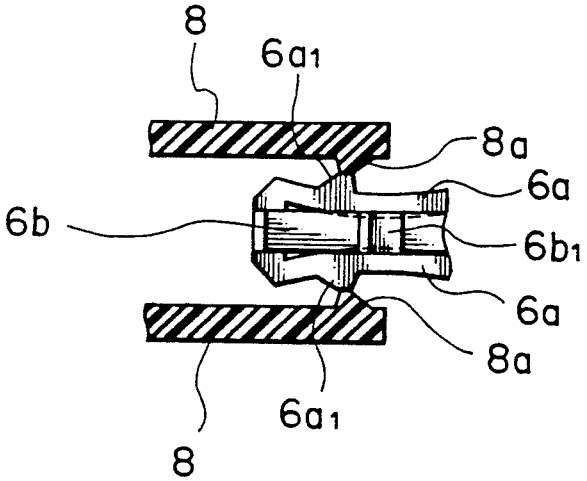
FIG. 5 is an illustration of the operation of vertically flexible pieces.
Figure 6:
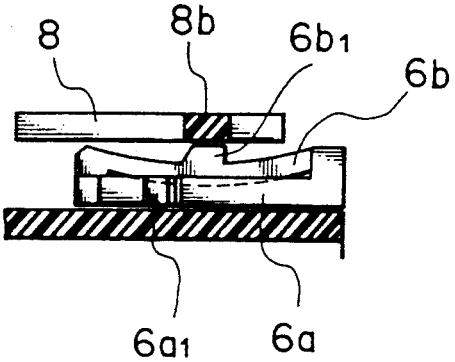
FIG. 6 is an illustration of the operation of a horizontally flexible piece.

At the times of the first-step engagement and the second-step engagement, the vertically flexible pieces 6*a*, 6*a* are flexibly deformed through the gap 6*c* (FIG. 5), and the horizontally flexible pieces 6*b* are each flexibly deformed while entering into the gap 6*c* (FIG. 6).

Figure 7A:
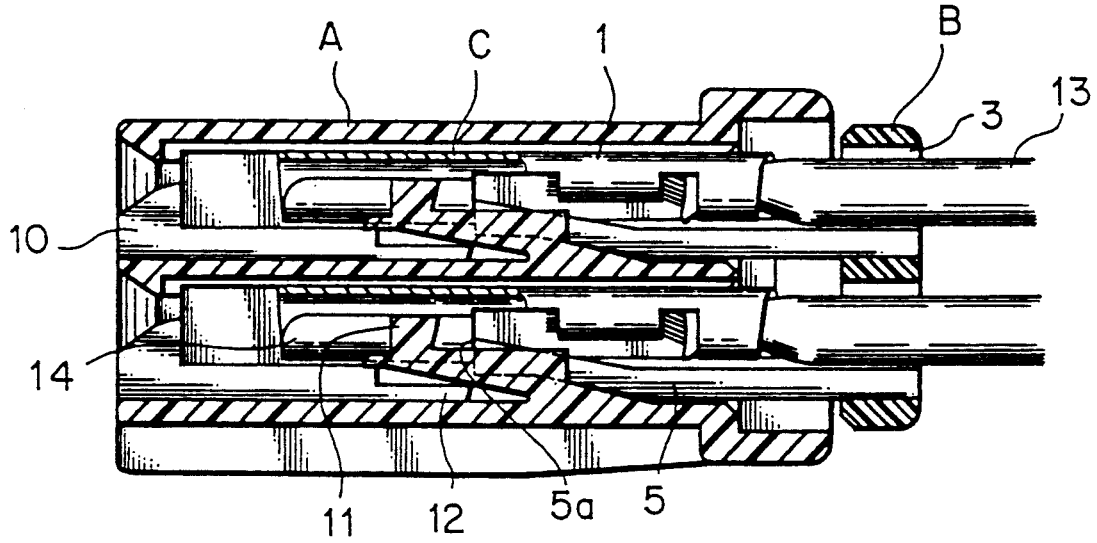
FIGS. 7A, 7B and 7C are each a sectional view showing the relationship between the connector housing, the terminal retainer and the terminal member, in which 7A shows the first-step engagement, 7B shows the second-step engagement, and 7C shows an unsatisfactorily inserted condition of the terminal member in the first-step engagement of the housing and the terminal retainer.
Figure 7B:
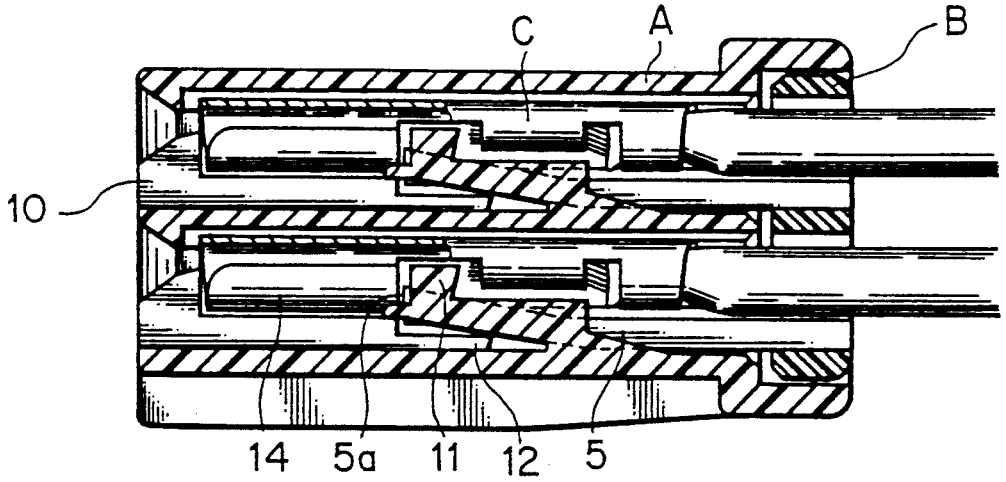
Figure 7C:
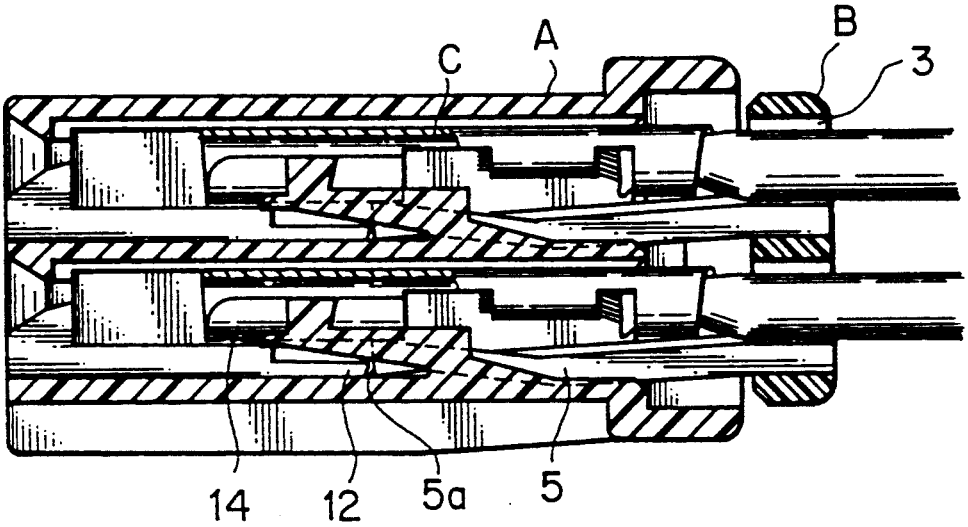

As shown in FIGS. 7A through 7C, in each terminal chamber 1 of the connector housing A, a stopper 10 is provided at the forward end, while a flexible locking arm 11 integral with the inner wall surface is provided at an intermediate portion. Further, stoppers 12 for detecting unsatisfactory insertion of the terminal member C are provided on both sides of the flexible locking arm 11 in a longitudinally aligned manner with the pair of flexible pins 5 projecting from the terminal retainer B. However, since the end portions 5*a* of the pins 5 are bent to be gradually inclined, said stoppers 12 will not normally interfere with said pins 5.

FIG. 7A shows the connector housing A and the terminal retainer B in the tentatively connected condition. In the process of establishment of the first-step engagement, each terminal member C connected with the electric wire 13 is inserted through the insertion portion 3 of the terminal retainer B into the terminal chamber 1. Therefore, an electrical contact portion 14 of the terminal member C is moved forward while displacing outwardly the engaging end portion 5*a* of the flexible pins 5 located on the advance path of the contact portion 14. When the electrical contact portion 14 rides over the engaging end portion 5*a*, the end portion 5*a* is restored by its own flexibility to be located in engagement with the rear end of the contact portion 14, as shown.

FIG. 7B shows the terminal retainer B in the second-step engagement shifted from the first-step engagement. Through this shift, the terminal retainer B advances to push the terminal member until the terminal member C abuts against the stopper 10.

FIG. 7C shows the insufficiently inserted terminal member C in the first-step engagement. In this case, the engaging end portion 5*a* of the flexible pin 5 is deflected by the electrical contact portion 14. Therefore, it is impossible to shift the terminal retainer B into the second-step engagement, because the engaging end portion 5*a* abuts against the stopper 12, thus indicating the unsatisfactory insertion of the terminal member C.

Figure 8:
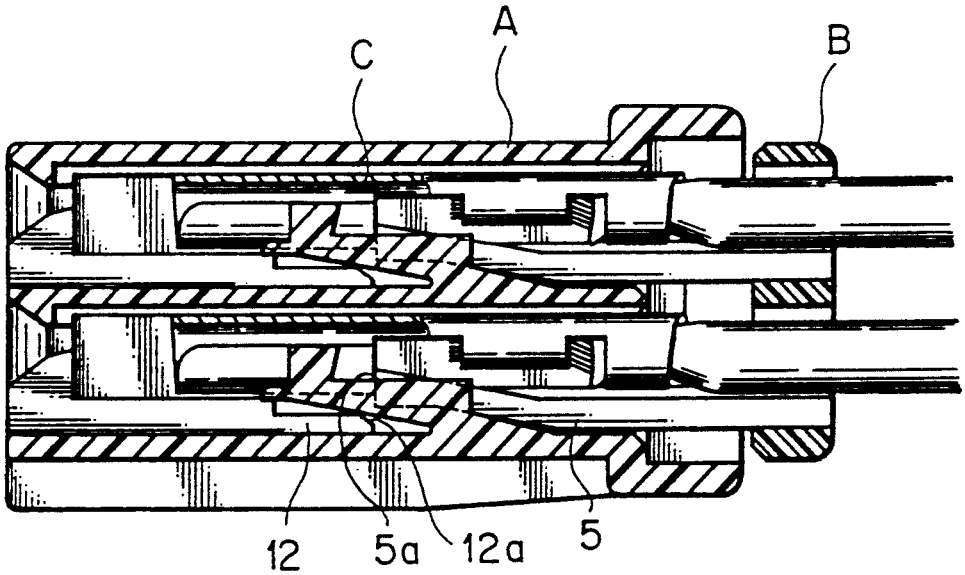
FIG. 8 is a sectional view of the connector housing according to another embodiment of the invention.
Figure 9:
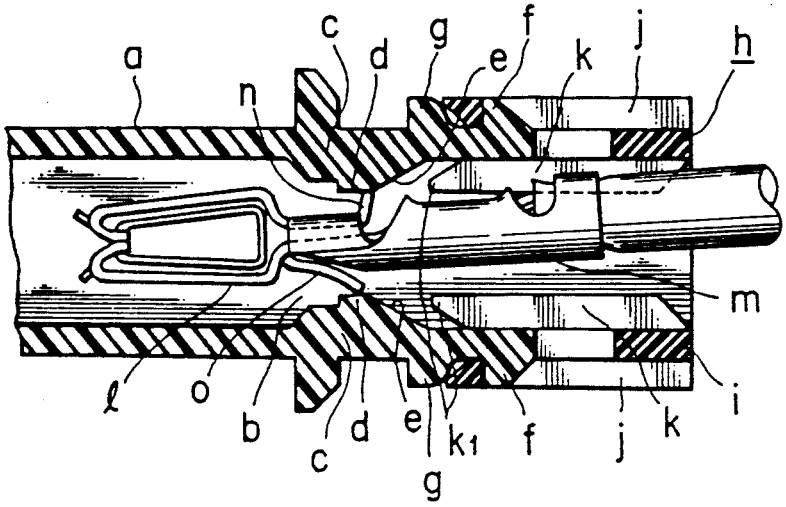
FIG. 9 PRIOR ART
FIG. 9 is a sectional view of a connector housing and a terminal retainer therefor according to an example of the prior art, in a first-step engagement.
Figure 10:
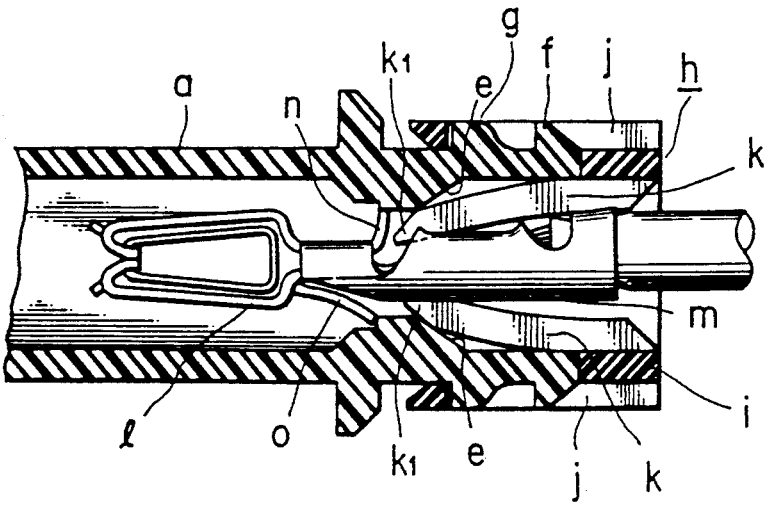
FIG. 10 PRIOR ART
FIG. 10 is a sectional view of the connector of FIG. 9 in a second step engagement.

FIG. 8 shows another embodiment of the invention, in which a stopper 12 for detection of unsatisfactory insertion is formed at a forward end thereof with a tapered (or arc-shaped) beveled portion 12*a*. In this embodiment, when the engaging end portion 5*a* of the flexible pin 5 makes contact with the stopper 12*a*, despite the sufficient insertion of the terminal metal piece C and the restoration of the engaging end portion 5*a* in the first-step engagement, due to a dimensional error in the members at the time of production thereof, the tapered portion 12*a* functions to actuate the flexible pins 5 into a correct pose, making it possible to move the terminal retainer B into the second-step engagement without trouble.

What is claimed is:

1. A connector comprising:

a connector housing having a plurality of terminal chambers;

a plurality of terminal members to be inserted in a respective said terminal chamber, each of said terminal members having an electrical contact portion; and a terminal retainer adapted for engaging with a rear portion of said connector housing initially in a first stage engagement position and then in a second stage engagement position, said terminal retainer having a plurality of flexible pins for extending into the terminal chambers of said connector housing, each of said terminal members being inserted into a corresponding said terminal chamber when said terminal retainer is in the first stage engagement position, each flexible pin of said flexible pins of said terminal retainer including an engaging end portion, each terminal chamber including a stopper for detecting unsatisfactory insertion of each said terminal member, each said stopper being located in a respective said terminal chamber such that said stopper abuts against the engaging end portion of one of said flexible pins on said terminal retainer for preventing said terminal retainer from shifting from said first stage engagement position to said second stage engagement position when said terminal member is unsatisfactorily inserted and such that said stopper does not interfere with satisfactory insertion of said terminal member, said flexible pin thereby allowing said terminal retainer to shift from said first stage engagement position to said second stage engagement position when said terminal member is satisfactorily inserted.

2. A connector as set forth in claim 1, wherein the engaging end portion of each said flexible pin is bent at a gradual incline such that insertion of said terminal member with said flexible pin of each terminal retainer deflects the engaging end portion of said flexible pin, the engaging end portion being deflected until the electrical contact portion of said terminal member engages with the engaging end portion.

* * * * *